US012686521B2

(12) United States Patent
Muff et al.

(10) Patent No.: US 12,686,521 B2
(45) Date of Patent: Jul. 21, 2026

(54) APPARATUS AND METHOD FOR THE FOLLOW-UP TREATMENT OF CONTAINER PRODUCTS

(71) Applicant: kocher-plastik Maschinenbau GmbH, Sulzbach (DE)

(72) Inventors: Alexander Muff, Buttisholz (CH); Michel Karasch, Neuler (DE); Maurizio Chiulli, Gschwend (DE); Thomas Lüscher, Muhen (CH)

(73) Assignee: ROMMELAG ENGINEERING GMBH, Sulzbach/Saar (DE)

( * ) Notice: Subject to any disclaimer, the term of this patent is extended or adjusted under 35 U.S.C. 154(b) by 0 days.

(21) Appl. No.: 18/872,485

(22) PCT Filed: Jun. 7, 2023

(86) PCT No.: PCT/EP2023/065178
§ 371 (c)(1),
(2) Date: Dec. 6, 2024

(87) PCT Pub. No.: WO2024/037752
PCT Pub. Date: Feb. 22, 2024

(65) Prior Publication Data

US 2025/0353633 A1 Nov. 20, 2025

(30) Foreign Application Priority Data

Aug. 17, 2022 (DE) ..... 10 2022 003 000.4

(51) Int. Cl.
*B65B 61/00* (2006.01)

(52) U.S. Cl.
CPC ..... *B65B 61/00* (2013.01); *B65B 2220/24* (2013.01)

(58) Field of Classification Search
None
See application file for complete search history.

(56) References Cited

U.S. PATENT DOCUMENTS 6,426,035 B1 7/2002 Hansen ..... 264/525
10,464,708 B2 11/2019 Geser et al.
(Continued)

FOREIGN PATENT DOCUMENTS

CN 205044140 U 2/2016
CN 111483153 A 8/2020 ..... B26F 1/38
(Continued)

OTHER PUBLICATIONS

Search Report for International Application No. PCT/EP2023/065178, 4 pages, Sep. 18, 2023.
(Continued)

*Primary Examiner* — Chinyere J Rushing-Tucker
(74) *Attorney, Agent, or Firm* — Slayden Grubert Beard PLLC

(57) ABSTRACT

Disclosed is an apparatus for the follow-up treatment, in particular cooling, of container products, which are produced by means of a blow-moulding, filling and closing process, and which can be fed to a follow-up treatment zone, which has an influencing effect, in particular a cooling effect, on the respective container product. The container products enter the follow-up treatment zone singly separate from one another or together in individual groups separate from one another comprising multiple container products. The follow up treatment zone is provided with at least one control means, acting on the container products and determining the time for which they stay in the follow-up treatment zone.

20 Claims, 3 Drawing Sheets

(56) References Cited

U.S. PATENT DOCUMENTS

| | | | | |
|---|---|---|---|---|
| 10,821,650 | B2 | 11/2020 | Hansen | |
| 11,027,862 | B2 | 6/2021 | Wong | |
| 2016/0243749 | A1* | 8/2016 | Sauter | B29C 49/6427 |
| 2021/0039303 | A1* | 2/2021 | Dorsch | B29C 49/42069 |

FOREIGN PATENT DOCUMENTS

| | | | | |
|---|---|---|---|---|
| CN | 212072919 | U | 12/2020 | B29C 49/66 |
| DE | 3831957 | C1 | 12/1989 | A61J 1/06 |
| EP | 0661111 | A2 | 7/1995 | |
| EP | 2180990 | B1 | 1/2011 | B26D 5/08 |
| EP | 2987618 | A1 | 2/2016 | |
| EP | 3151807 | B1 | 9/2019 | A61J 1/06 |

OTHER PUBLICATIONS

Liu, Wei et al., "Biopharmaceutical Manufacturing Using Blow-Fill-Seal Technology," BioPharm International, vol. 24, Issue 7, 18 pages.

* cited by examiner

APPARATUS AND METHOD FOR THE FOLLOW-UP TREATMENT OF CONTAINER PRODUCTS

CROSS-REFERENCE TO RELATED APPLICATIONS

This application claims priority to German Patent Application DE 10 2022 003 000.4, filed on Aug. 17, 2022 with the German Patent and Trademark Office. The contents of the aforesaid Patent Application are incorporated herein for all purposes.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure. The disclosure relates to an apparatus for post-treating, particularly for cooling, container products that are produced by means of a blow moulding, filling and sealing process (BFS) and can be supplied to a post-treatment zone that applies an influential, particularly cooling action to the respective container product.

EP 3 099 467 B1 discloses a generic device for producing container products from plastics material, which are part of a continuous belt leaving a non-intermittent BFS production machine, which were previously moulded by means of a moulding device, furnished with a pre-definable container content by means of a filling device and closed by means of a closing device, wherein the moulding device comprises individual mould sections which are moved in pairs on top of one another, to and away from each other, to close and/or open a production mould, in which the respective container product is moulded, furnished with the container content and closed. The finished container products are then supplied in sequence, one after the other, as a continuous belt, to a post-treatment zone in which an action, particularly a temperature-influencing action is applied to the respective container product and/or to the respective container content. As a result, a controlled temperature influence on the respectively filled and sealed container product is achieved during a post-treatment phase of the continuous belt in the post-treatment zone in order to maintain the stability and in particular the biological activity of the respective filling material and to produce BFS containers that are simultaneously well moulded and leaktight. In this manner, the filled container product that is in each case located in sequence, one after the other, on the continuous belt is supplied to the post-treatment zone and cooled by convective cooling of the container product for a duration of for example at least 20 seconds. In the case of products for medical purposes, this takes place under strictly controlled good manufacturing practices (GMP) and conditions, in particular with regard to directed air flows in the cleanroom.

In the case of intermittent machines, small-volume containers (with filling volumes of typically less than 30 ml) or groups thereof are produced in a composite frame. To this end, a plastic tube is extruded in the extrusion position of the BFS facility, said tube being received in a cooled multi-part mould, the lower container part, the container body, being moulded by negative pressure and cooled by applying onto the mould. The plastic tube is then separated and, located in the cooled mould, transferred to a filling position. This transfer process typically lasts for between 0.5 to 2 seconds. The container body also cools down further during this period due to contact with the cooled mould. Cooling down of the top region of the container is deliberately substantially avoided. Filling of the container body and sealing of the container then take place by closing the top jaw of the mould and welding the container top, which is still hot. A blowing operation for forming purposes is not required with such small-volume containers—in contrast to large-volume containers such as bottles with filling volumes of 30 ml and over.

U.S. Pat. No. 11,027,862 B2 recommends an additional cooling step for the respective formed but unfilled container for such BFS machines, the cooling step consisting of waiting a further two to five seconds after forming the container before filling and thus delaying the time of the filling operation. As such, heat from the empty container body is transferred to the cooled form by contact; wherein the top of the container must, however, remain 'hot' as the top can otherwise no longer be reliably formed and sealed or welded respectively after filling. In this respect, the container can only be partially cooled.

In both of the aforementioned proposed solutions it is evident that the composite frame arising when producing the respective container, which is shown in FIG. 1 of EP 2 180 990 B1 by way of example, needs to be cooled including a so-called waste edge zone, which requires very high cooling outputs and/or cooling times in consideration of the fact that the waste zone, especially in intermittent machines, often makes up over 30% of the entire plastics material used. As a result, the amount of heat acting on the filling material is considerably higher than the amount of heat from the actual container. This requires high cooling outputs after unmolding, particularly large volume flows of cooling air, which is disadvantageous as the airflow directions resulting in the cleanroom may be modified in an uncontrollable manner.

These production processes, which are intrinsically advantageous, all represent high-temperature processes to a greater or lesser extent, as, with the plastics materials that are advantageously used, homogenisation of the molten polymer mass, distribution in the top of the tube of the BFS production machine and forming, and, in particular, hermetic sealing of the container require relatively high temperatures. Due to the high temperature level in the forming phase, the intrinsically advantageous BFS processes are less well suited to temperature-sensitive filling material. Formulations of drugs and diagnostic materials produced by biotechnology often come into consideration as filling material for containers in the form of ampoules. This group of substances includes therapeutic proteins, coagulation factors, a range of hormones such as insulin, epoetin or growth hormones, monoclonal antibodies and vaccines produced by biotechnology. Due to temperature-related problems, such substances are not generally marketed in BFS containers, but in conventional glass vials.

This problem has already been raised in the professional field and is the subject of current scientific discussion. In this respect, reference is made to a publication by Wei Liu, Philippe Lam et al which appeared in Bio Pharm International July 2011, pages 22 to 29. To prevent damage to the filling material, the authors suggest supplying the respective pharmaceutical formulation very cold. However, in the context of BFS technology, this can only be performed with difficulty in processes that have to be performed quickly with high discharge rates because reducing the temperature leads to an increase in the viscosity of the filling material, which would require increased filling pressures over the same filling period, although this could in turn have a disadvantageous effect on the stability of the filling material due to the fact that most proteins are sensitive to shearing. Another disadvantage of supplying cooled filling material with temperatures of less than 15° C. is that this can cause humidity to condense in the BFS production machine and, in particular, on the filling tube thereof. This can cause condensed water to be wiped off from the container opening, which in turn can lead to leaks when sealing the container. If, as would appear to be correspondingly evident, low moulding temperatures of less than 15° C. are set, this can also cause condensation effects, which would in turn require time-consuming and costly dry air treatment for the mould surfaces, leading to temperatures around the top region and on the top jaw of the mould that would no longer reliably guarantee hermetic sealing. Reducing the container wall thickness is likewise only rarely a reasonable and efficient option to minimise the available amount of heat acting on the filling material, as the container wall thicknesses are determined by pre-defined parameters, for example by the permissible permeation loss (water loss over the storage period due to permeation) and mechanical specifications (mechanical stability, opening behaviour, deformability for emptying purposes, etc.).

SUMMARY

A need exists to improve the known solutions to provide an energy-efficient and economical post-treatment, for example cooling, of filled and sealed BFS container products.

The need is addressed by the subject matter of the independent claim(s). Embodiments of the invention are described in the dependent claims, the following description, and the drawings.

DESCRIPTION

Figure 1:
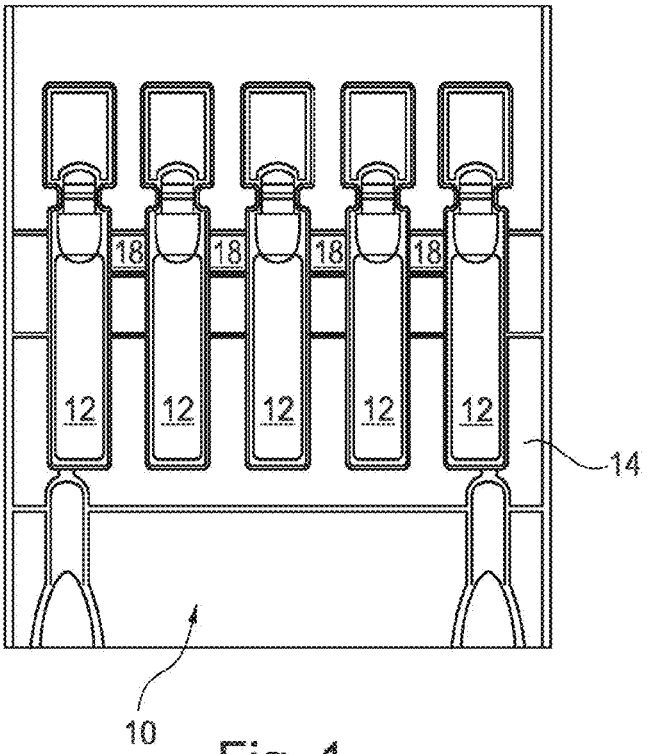
FIGS. 1 and 2 represent an example composite frame shown in a front view, consisting of an ampoule block and the waste frame; or an ampoule block with the waste frame removed, respectively, in which the individual container products are connected together with partition wall webs in a detachable manner as a commercial unit.

The details of one or more embodiments are set forth in the accompanying drawings and the description below. Other features will be apparent from the description, drawings, and from the claims.

In the following description of embodiments of the invention, specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

In some embodiments, the container products, separated from one another or combined in individual separate groups with a plurality of container products, into which, furnished with corresponding control means, which determine the length of stay of the container products in the post-treatment zone, a post-treatment zone is created for the filled and reliably sealed container products, which enables the resulting containers, irrespective of the cycle times of the actual BFS production machine, to be left in the post-treatment zone long enough for the pre-definable post-treatment step to be completed, in particular for the desired temperature to be reached. In particular, the container products are no longer in sequence, one after the other, as part of a continuous production chain in the form of the continuous belt, with the result that the post-treatment and its duration can be pre-determined independently of the BFS machine production cycle, which permits a range of freedoms in connection with post-treatment, in particular carrying out a cooling operation. As such, even very temperature-sensitive filling material can be filled into BFS containers.

In some embodiments, it is provided that, in a production step preceding post-treatment, the respective container product is at least partially separated, for example completely, from a waste frame arising during production. As a result, the amount of heat contained in the waste edge zone no longer needs to be dissipated by cooling. In this respect, the amount of heat to be dissipated by the post-treatment zone is then only determined by the actual container product plus the filling material. Overall, the apparatus allows a method to be performed for efficient cooling of filled and sealed BFS container products in the cleanroom, particularly BFS ampoules for medical purposes.

In some embodiments, it is provided that the container products pass through the post-treatment zone with the aid of gravity, for example in free fall, until such a time as the control means take effect on the container products. As a result, the length of time until the container product enters the post-treatment zone is reduced, with the result that the influence of heat on the filling material is minimised and thus the quality of the filling material is not substantially impaired.

In some embodiments, it is provided that the post-treatment zone comprises at least one through shaft for transferring through the container products, which, for example on the bottom side, enables or prevents the outward transfer operation from the through shaft for the container products by means of the control means. As such, the length of stay of the respective container product in the post-treatment zone can be pre-defined and, surprisingly, it has been shown that, due to the impact or collision, respectively, of the container product on the base that temporarily seals the through shaft, this leads to a beneficial mixing of the container content without substantially increasing wetting of the inner surface of the container. In this manner, it is also possible to even out the heat content in the container product, which helps improve cooling by means of the post-treatment zone.

In some embodiments, it is provided that the post-treatment zone comprises, along a fall line for the container products, a plurality of through shafts arranged behind one another with the individual control means. For example, in this case the respective through shaft is designed as a chamber which is open at the top and bottom at its free end faces, which are opposite one another, for transferring through the container products, the opening being able to be sealed by means of the control means, for example incorporating a movable base part, and the container walls, which of the container products being are opposite one another, transferred through, along the adjacent chamber walls of the respective chamber with a spacing that can be pre-defined. As such, the post-treatment zone can be subdivided into at least two partial regions or chambers respectively, which can be separated from one another, permitting a kind of stepped cooling. In this case, preliminary cooling of the container product is first performed in sequence in the preceding front chamber and additional cooling is performed in the following main chamber, viewed in the direction of through transfer. In this case, both chambers, which at least partially delimit the through shaft, are separated from another temporarily by the base that can be moved between them or the movable base part respectively. By horizontally displacing the movable base part, products, individually or combined in individual container blocks, while retaining a vertical container orientation, as defined by the BFS production machine, pass directly, by gravity, from the preceding front chamber into the spatially adjacent main chamber.

In some embodiments, it is provided that each chamber comprises at least one inlet for a tempering medium, such as a cooling fluid. Cooling takes place in the respective chamber via a cooling fluid, for example in the form of a liquid, a gas or gas mixture, such as carbon dioxide, nitrogen, etc., but standard ambient air is used from preference. The heated exhaust air arising during cooling is discharged in the upper region of the respective chamber and can be dissipated.

For example, it is proposed in this case that a plurality of inlet nozzles are fitted in parallel with the respective chamber walls of a chamber, said inlet nozzles extending through the chamber wall with their delivery side and as such introducing the tempering medium into the through space of the chamber, for example at a point at which the container products are held in the chamber by the control means in such a way that the tempering medium is in contact with the container product and/or the container content, for example at a right angle. The tempering medium for example makes contact close to the bottom of the container product and for example the tempering medium is directed such that it makes contact substantially beneath the filling level of the container product. The stepped cooling according to the teachings herein leads to overall cooling times of significantly less than 20 seconds, with the result that a cooling time of less than approximately 10 seconds arises for each chamber in a two-chamber configuration. These cooling times also arise when using relatively low cooling outputs. Accordingly, the production cycle for the containers does not need to be extended and the inherent high efficiency or cost-effectiveness, respectively, of the BFS production process is still maintained in connection with post-treatment.

Stepped cooling does not need to be restricted to two steps with two chambers; instead, cooling can be performed with just one step or, by using additional further chambers, three or multi-step cooling can be performed.

For example, it is proposed that the respective chamber volume is no larger than 30 times the volume of the respective container product, for example less than 20 times said volume. Accordingly, it is beneficial for tempering or cooling purposes respectively to keep the volume of each treatment chamber in the post-treatment zone as low as possible.

In some embodiments, the respective through shaft can be moved between a transfer position for transferring in the container products and a transfer position for transferring out said products by means of a displacement device. Accordingly, during the actual treatment operation with the post-treatment zone, a movement of the container product received in each case may take place, representing a further opportunity for decoupling between the production machine, which for example produces container products on a continuous basis, and the post-treatment zone required to temper, and in particular to cool, these containers.

The disclosure also relates to a method for post-treating container products, particularly those produced by means of a blow moulding, filling and sealing process, using an apparatus as specified herein. As such, the container products are admitted to the post-treatment zone individually or combined in groups after at least partially removing the waste frame, the length of stay of the respective container products in the post-treatment zone being pre-defined by control means. The post-treatment does not need to be limited to tempering operations, in particular cooling or additional heat treatment operations. Other post-treatments that can also be combined together are also entirely feasible in this case, such as, for example, irradiating the filled container, for example to reduce the bacterial count by high-energy radiation (visible light, UV radiation, beta, gamma or X-ray radiation, microwaves) or carrying out a sensory check, such as carrying out visual inspections on the container product and/or the contents. Thus, for example, cooling may take place in a first chamber, with irradiation in a second chamber and inspection in a further chamber. Accordingly, the individual chambers of the post-treatment zone also do not need to be arranged in an immediate sequence one after the other but can also be located a pre-definable axial distance apart from one another by using an intermediate space.

For example, the method is performed such that a tempering medium, in particular a cooling fluid, is admitted intermittently into the post-treatment zone, admission of the tempering medium for example being reduced while inserting the respective container product into the post-treatment zone. As such, the required post-treatment can be performed in a particularly controlled manner.

Reference will now be made to the drawings in which the various elements of embodiments will be given numerical designations and in which further embodiments will be discussed.

Specific references to components, process steps, and other elements are not intended to be limiting. Further, it is understood that like parts bear the same or similar reference numerals when referring to alternate FIGS.

The composite frame 10 shown in FIG. 1 consists of a plastics material, for example a polyolefin material such as polyethylene or polypropylene. However, materials containing cyclic olefin materials such as COP or COC or aromatic polyester materials such as PET, PEN or PEF (polyethylene furanoate), can also be used.

Figure 4:
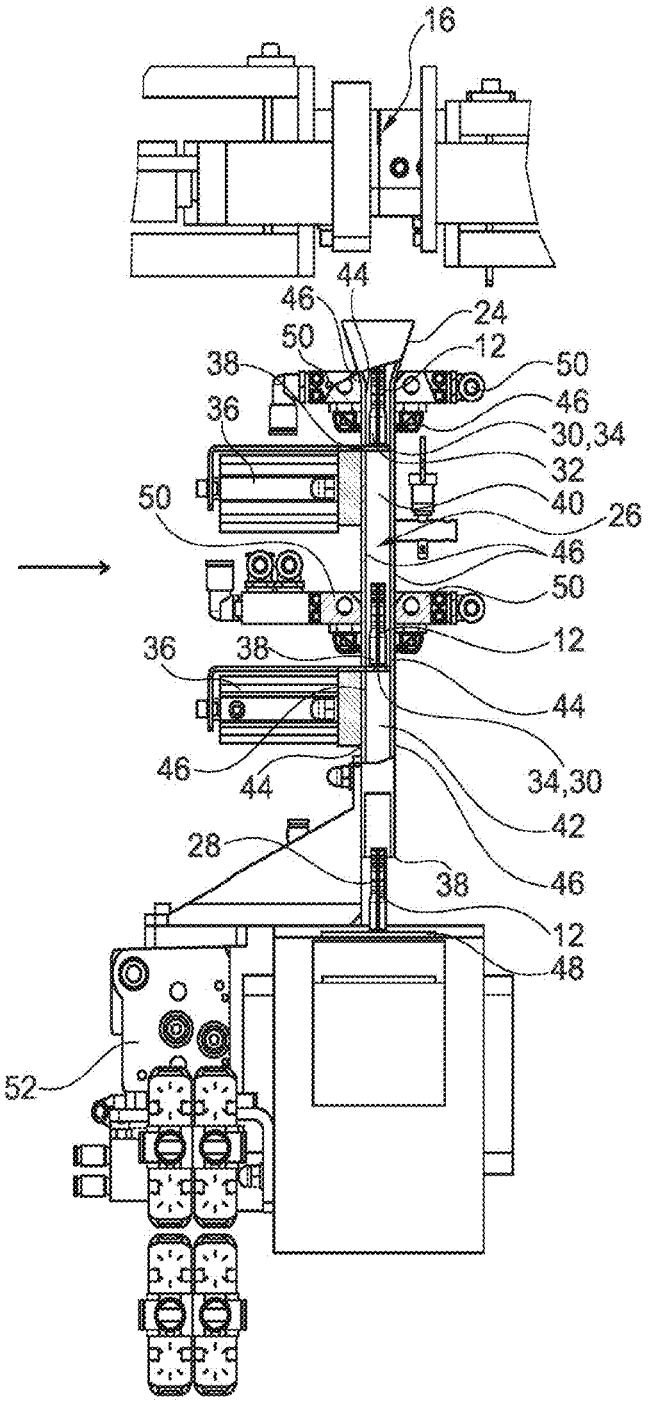
FIG. 4 shows a front plan view; partially as a sectional view, partially a view of the example apparatus according to FIG. 3, which is arranged beneath an example separation/punching device.

The composite frame 10 is generally composed of the actual container products 12 and the so-called waste frame 14, which should be at least partially separated from the actual container products 12 by means of a separation or punching apparatus 16, part of which is shown in FIG. 4 and which is the detailed object of EP 2 180 990 B1, for example.

Figure 2:
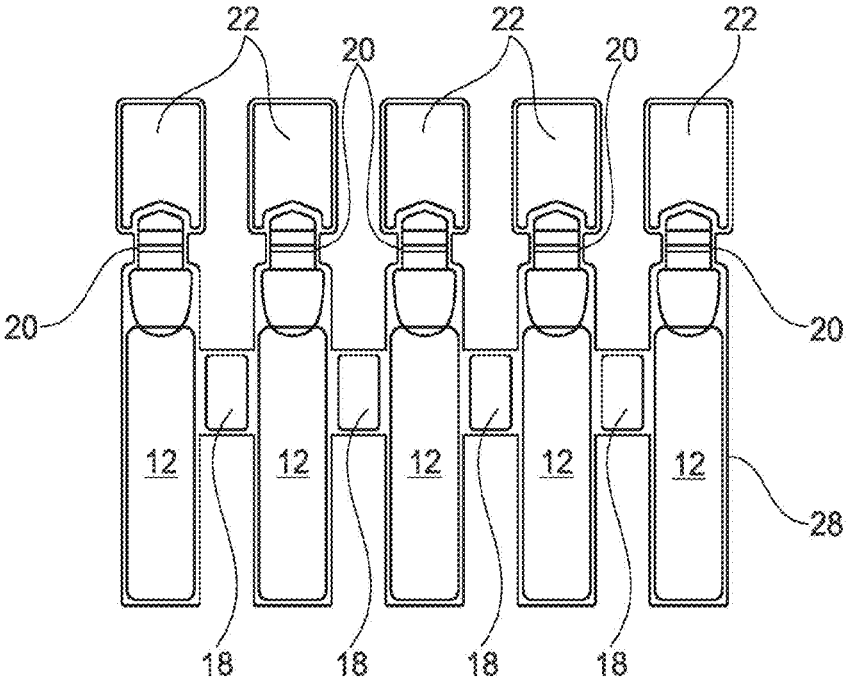

If the container products 12 are separated from the majority of the waste frame 14, this thus leads to an ampoule block that is substantially released from the waste frame 14 in accordance with the representation in FIG. 2, the individual container products 12 or individual ampoules being connected to one another via remaining partition wall webs 18 of the waste frame 14, wherein the partition wall webs 18 make it possible to separate the respective container product 12 from the other containers remaining in the block in the form of a twist-off movement.

The respective container product 12 is known in the art and described in DE 38 31 957 C1, for example. Corresponding ampoule blocks are produced as part of the blow moulding, filling and sealing process (BFS), which has been state of the art for many years. In this respect, the basic form shown in FIGS. 1 and 2 is only one kind of an embodiment and, in particular, the container geometries may be defined by users within a very wide context and produced in the BFS process. In order to release the container content, generally in the form of a pre-filled fluid, a toggle closure 20 is usually used, which can be separated from the rest of the container product 12 using a handle 22, also in the form of a twist-off movement, via a corresponding defined breaking point, with the result that the fluid can be extracted via the released container opening, typically for medical purposes. Other container opening solutions incorporating dropper caps or insert parts as known from EP 3 151 807 B1 can also be produced.

The ampoule block represented in FIG. 2 then leaves the punching device 16 vertically at the bottom, in the viewing direction shown in FIG. 4, and as such passes to the inlet side 24 of the post-treatment zone referred to in its entirety as 26. The ampoule block shown in FIG. 2, substantially released from the waste frame 14, thus forms a group 28 with a plurality of container products 12, which, combined together accordingly, enter the post-treatment zone 26 via the inlet side 24 thereof. Each group 28 leaving said punching device 16 thus passes to the inlet side 24 of the post-treatment zone 26 such that the incoming groups 28 are in each case treated, in particular cooled as part of a tempering process, in sequence, one after the other. However, it is also possible for individual container products 12 from a BFS production machine to pass directly to the inlet side 24 of the post-treatment zone 26 by omitting the punching device 16. It is also conceivable, if necessary, to supply container products 12 together with the composite frame as shown in FIG. 1 individually in this manner to the post-treatment zone 26. Even with the composite frame or waste frame 14 respectively, there is still an improved cooling effect for the container fluids to be tempered accordingly. As is also shown on FIG. 4, the post-treatment zone 26 is furnished with individual control means 30, which act on the container products 12 to determine their length of stay in the post-treatment zone 26.

The punching device 16 shown in part in FIG. 4 is located beneath a filling position of a BFS production machine, which is not shown in further detail, and as such accepts the product shown in FIG. 1, consisting of the containers 12 which are embedded in the waste frame 14 surrounding said containers, wherein, due to the associated plastics forming process, the plastics materials continue to be correspondingly 'hot', which may have a detrimental effect on the filling material in the respective container product 12 if this is correspondingly temperature-sensitive.

After punching out the container products 12, the product shown in FIG. 2 is obtained when the waste frame 14 falls away, said product leaving the punching device 16 in the direction of fall, viewed from top to bottom, and then reaching the funnel-shaped inlet side 24 of the post-treatment zone 26. Accordingly, the container products 12 enter the post-treatment zone 26 with the aid of gravity, for example in free fall, and pass through said zone until the respective control means 30 takes effect on the respective container product 12. In this respect, the treatment zone 26 comprises a first through shaft 32 for transferring through the container products 12 according to FIG. 2, said through shaft 32 comprising a horizontally movable base 34 as a control means 30, said base being able to be moved into the plane of projection according to the viewing direction on FIG. 4 by means of an associated drive 36 in order to thus release the outlet side 38 of the first through shaft 32. As shown in FIG. 4, the base 34 is in its closed or locked position and the container products 12, grouped in a card as shown in FIG. 2, are upright with their container body on the top side of the base 34. By falling onto the base 34 via the inlet side 24, this leads to a beneficial mixing of the container contents from a thermal point of view, which improves cooling.

Figure 3:
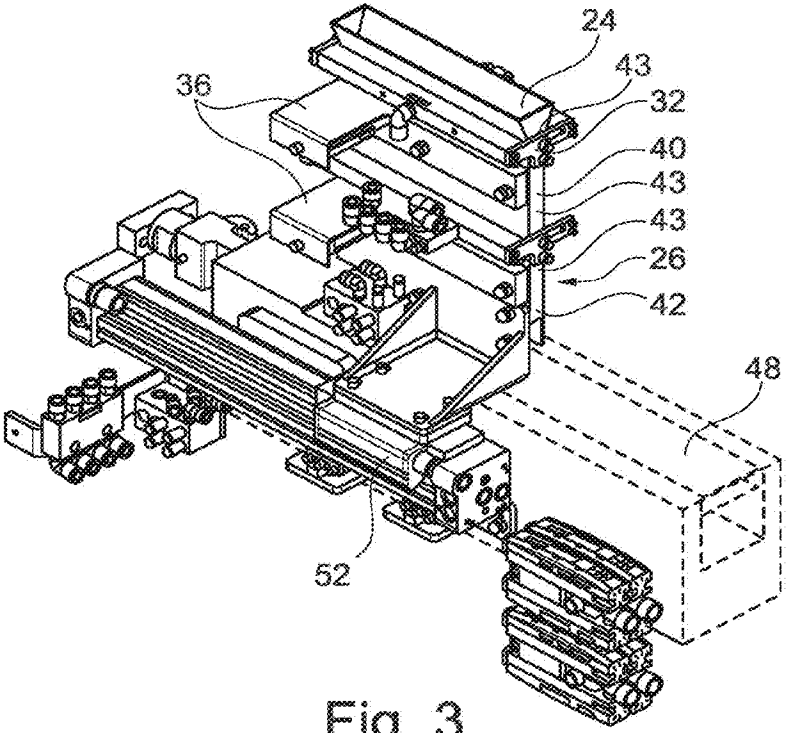
FIG. 3 shows a perspective plan view of components of the example post-treatment apparatus.

As is also shown on FIG. 4, the post-treatment zone 26 comprises a plurality of through shafts 32, 40 and 42 arranged one after the other along a notional vertical fall line for the container products 12, with individual control means 30 in each case, specifically from 32 to 40 and from 40 to 42. The respective through shaft 32, 40, 42 is configured as a box-shaped chamber 44 with a rectangular free cross-section on the inside, each chamber 44 being open at the top and bottom on its two opposite end faces for transferring through the container products 12 as long as the respective base 34 is not closing the associated through shaft 32, 40. As is also shown in FIG. 4, the opposite container walls of the container products 12 are passed through, along the adjacent chamber walls 46 of the respective chamber 44, with a small spacing that can be pre-defined. Furthermore, each chamber 44 is configured to be closed along its two opposite longitudinal sides 43 (FIG. 3).

As shown in FIG. 4, the container products 12 in the composite card are located in the through shaft 32 arranged at the very top, which is sealed at the bottom by the associated base 34. Additional container products 12 as shown on FIG. 2 are located in the second through shaft 40, which is in turn sealed at the bottom by a base 34 such that the middle chamber 44 is sealed at its free end faces at the top and bottom by a base 34 in each case. In the last and third through shaft 42, container products 12 according to FIG. 2 are in turn located on the outlet side 38, said container products being placed on a drivable conveyor belt 48 to be transported away from the post-treatment zone 26. The base 34 between the second through shaft 40 and the third through shaft 42 is also arranged such that it can be moved to and from, by means of an associated drive 36, within the post-treatment zone 26 in the same direction as the base 34 arranged at the very top.

As soon as the conveyor belt 48 has transported away an ampoule product as shown in FIG. 2 and tempering, in particular cooling, for the container products 12 in the post-treatment zone 26 is complete, the two bases 34 can be moved into their open position, releasing the outlet side of the respective through shaft 32, 40 such that the ampoule block located in the second through shaft 40 passes onto the conveyor belt 48 after passing through the third through shaft 42 and the ampoule block arranged above this with the container products 12 passes from the first through shaft 32 into the second through shaft 40. The punching device 16 can then, in turn, release an ampoule product, which passes into the first through shaft 32 via the funnel-shaped inlet side 24 with the base 34 closed. It is evident that the base 34 for the second through shaft 40 must also be closed in this case so that it can catch the released ampoule product arranged above this. As such, according to the embodiment shown in FIG. 4, a two-step cooling process is achieved for the container products 12 by means of the two through shafts 32, 40, the length of the first through shaft 30 for example being designed to be shorter than the following through shaft 40.

Figure 5:
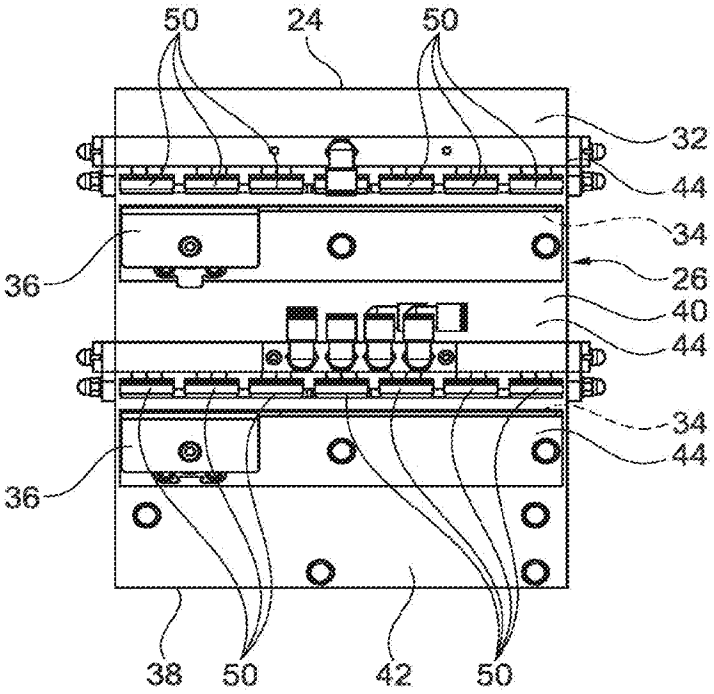
FIG. 5 shows a partial side view in the direction of the arrow according to the representation shown in FIG. 4; without the example separation/punching device and without an example transport device in the form of a conveyor belt.

As is also shown on FIG. 4, at least one inlet 50 for a tempering medium, such as a cooling fluid, is provided above the respective base 34 and each chamber 44. As shown in FIG. 5, seven slotted nozzles are in this case provided for each chamber 44 as the respective inlet 50, said nozzles for example being arranged in opposition on the chamber wall 46 on opposite sides at the same height. Accordingly, a plurality of inlet nozzles are fitted as the respective inlet 50, running in parallel with the respective chamber walls 46 of a chamber 44, said inlet nozzles extending through the chamber wall 46 with their delivery side and as such introducing the tempering medium into the inner or through space of the respective chamber 44. In this process, the tempering medium comes into contact with the container product 12 with its container content, for example at a right angle. The cooling fluid is for example a gas or gas mixture, $CO_2$, nitrogen, or for example air. The inflow time for the cooling fluid for each chamber 44 is less than 0.6 minutes, for example less than 0.4 minutes, for example less than 0.3 minutes.

As is also shown in FIG. 4, the respective chamber volume of a chamber 44 is no larger than thirty times the volume of the respective container product 12. The volume is for example less than twenty times the container product 12. As is particularly evident from FIG. 3, the entire post-treatment apparatus is arranged such that it can be moved to and from by means of a displacement device 52 with respect to the punching device 16 and the conveyor belt 48, wherein, as shown in FIG. 3, the post-treatment zone 26 is located in a rearward displacement position beneath the punching device 16, which is not shown in FIG. 3. In this manner, the process of transferring the container products 12 into the post-treatment zone 26 in a rearward region and transferring them out onto the conveyor belt 48 in a front region can be at least partially disconnected from a predefined machine cycle of the BFS production machine and/or the punching device 16.

It has been proven to be beneficial, if at all possible, to largely avoid relative movements of the liquid with respect to the container product 12 at least until it is removed from the respective chamber 44. This is in particular achieved by intermittent flows of the cooling fluid, in particular by interrupting the supply via the respective inlet 50 during admission/discharge of the container products 12 into or out of the respective chamber 44. This reliably prevents wobbling or vibration of the container products 12 and an undesirable increased heat transfer from the plastics material to the temperature-sensitive container content.

Directing the cooling fluid in the main chamber, which is formed by the second through shaft 40, takes place in a similar manner as in the front chamber 44, which is formed by the first through shaft 32, but for example with a delayed time cycling of the cooling flows via the respective inlet 50. Surprisingly, it is apparent that overall cooling times of significantly less than 20 seconds can be achieved, in particular by virtue of the stepped cooling according to the teachings herein, in other words less than approximately 10 seconds per chamber 44 in each case, with the result that efficient cooling is achieved even with low cooling outputs. Thus, the production cycle for the container products 12 does not need to be disadvantageously extended and the high efficiency, i.e. cost effectiveness, of the BFS production process is still maintained.

It has also been shown to be beneficial to select the gap between the respective container product 12, which can also be grouped in a container block as shown in FIG. 2, and the inner or chamber wall 46 of the respective chamber 44 within a range from 1 mm to 5 mm, for example from 2 mm to 4 mm, which on the one hand increases the cooling effect, but on the other hand reliably prevents scratching of the container surface. However, the gap between the container product 12 and the respective longitudinal side 43 of a chamber 44 is less than 0.5 cm, for example less than 0.3 cm.

Optionally, it is also possible to carry out three-step cooling, should this be necessary on the product side, wherein an additional main chamber with cooling such as the second through shaft 40 will then need to be added in an identical manner along the specified vertical fall line.

As already explained, the entire post-treatment zone 26 with its individual chambers 44 is guided such that it can be moved in a linear manner in the horizontal operating position and the container products 12 are guided while retaining their spatial orientation, in which the top of the container is arranged at the top, while they move in the individual cooling shafts 32, 40 from the position beneath the punching device 16 further down towards the outlet side 38 in the direction of the conveyor belt 48 with the cooling interruptions. In the transfer position, the base 34 of the main chamber 44 in the form of the second through shaft 40 in each case opens such that the thus cooled container can be transferred via the third through shaft 42 onto the transport device in the form of the conveyor belt 48.

In some embodiments which are not described in greater detail, a plurality of chambers 44 can also be fitted adjacent to one another in the shaft and transferred accordingly by means of a linear movement.

In some embodiments which are not described in greater detail, the chamber walls 46 may be configured as a cooling jacket, for example by means of a double-wall arrangement and a liquid cooling medium between said walls.

The device according to the teachings herein and the method not only make it possible to use the BFS process for temperature-sensitive filling materials. A further benefit, when using partially crystalline materials such as LDPE, HDPE, PP or PET, is the ability to specifically influence crystallisation of such materials in order to affect the optical, mechanical, thermal and chemical properties of the container products.

In some embodiments which are not described in greater detail, the container products 12 can optionally also be simultaneously treated in the apparatus according to the teachings herein with high-energy radiation, for example in the form of beta radiation, UV radiation, light or light pulses to reduce microbiological contamination of the contents. Instead of cooling, it is also possible to at least partially apply a heat treatment in the post-treatment zone 26, for example by hot air, microwave and/or infrared radiation in order to homogenise or reduce bacteria in the container contents.

In some embodiments, very good cooling results were achieved by using a block comprising 15 connected container products 12 in each case, with block dimensions of width×height×depth (WHD) of approximately 184 mm×53 mm×10 mm.

The respective cooling shaft, formed by the through shafts 32, 40 and, if applicable, 42, should for example have dimensions with a width×height×depth (WHD) of approximately 210 mm×250 mm×13 mm, the height of the front chamber in the form of the first through shaft 32 being approximately 59 mm and the height of the main chamber in the form of the second through shaft 40 being approximately 105 mm.

A 'Wisperblast' multi-channel flat jet nozzle made by Lechler GmbH in Metzingen, Germany is used as nozzles or as a respective cooling inlet 50 respectively. A cold air generator of the type known as Colder manufactured by Kager GmbH in Dietzenbach, Germany has proved to be effective.

The cooling air should for example arrive via the nozzles or the respective inlet 50 at approximately −10° Celsius with a volume flow onto the container products 12 within the block of approximately 400 standard litres/min. This results in a very short stay time of approximately 8 seconds per chamber 44 for the product to be cooled.

The solution described above leads to an energy-efficient and economically beneficial apparatus in addition to a method for post-treating, in particular cooling, filled and sealed BFS container products 12 in a cleanroom, in particular BFS ampoules for medical purposes.

The invention has been described in the preceding using various example embodiments. Other variations to the disclosed embodiments may be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor, device, or other unit may be arranged to fulfil the functions of several items recited in the claims. Likewise, multiple processors, devices, or other units may be arranged to fulfil the functions of several items recited in the claims.

The term "exemplary" used throughout the specification means "serving as an example, instance, or exemplification" and does not mean "preferred" or "having advantages" over other embodiments. The terms "in particular" and "particularly" used throughout the specification means "for example" or "for instance".

The mere fact that certain measures are recited in mutually different dependent claims or embodiments does not indicate that a combination of these measures cannot be used to advantage. Any reference signs in the claims should not be construed as limiting the scope.

What is claimed is:

1. A apparatus for post-treating container products that are produced by a blow moulding, filling and sealing process, and that can be supplied to a post-treatment zone that applies an influential action to the respective container product; wherein the container products, individually, separated from one another, or combined in individual separate groups comprising a plurality of container products, enter the post-treatment zone, which, furnished with at least one control means acting on the container products, determine the length of stay of said container products in the post-treatment zone; wherein the container products pass through the post-treatment zone with the aid of gravity in free fall until the respective control means starts to take effect on the container products.

2. The apparatus of claim 1, wherein the respective container product is at least partially separated from a waste frame arising during production by means of a separation or punching apparatus.

3. The apparatus of claim 1, wherein the post-treatment zone comprises at least one through shaft for transferring through the container products, which, using the respective control means, enables or prevents the outward transfer operation from the through shaft for the container products.

4. The apparatus of claim 1, wherein the post-treatment zone comprises, along a fall line for the container products, a plurality of through shafts arranged behind one another with the control means.

5. The apparatus of claim 1, wherein a respective through shaft-is configured as a chamber, which is open at its free end faces, which are opposite one another, for transferring through the container products, wherein the bottom opening can be sealed by the control means, and wherein the container walls, which are opposite one another, of the container products are transferred through, along the adjacent chamber walls of the respective chamber with an average spacing that can be pre-defined.

6. The apparatus of claim 1, wherein each chamber comprises at least one inlet for a tempering medium, such as a cooling fluid.

7. The apparatus of claim 1, wherein a plurality of inlet nozzles are fitted in parallel with the respective chamber walls of a chamber, said inlet nozzles extending through the chamber wall with their delivery side and as such introducing the tempering medium into the through space of the chamber.

8. The apparatus of claim 1, wherein the respective chamber volume of a chamber is no larger than 30 times the volume of the respective container product.

9. The apparatus of claim 1, wherein the respective through shaft can be moved between a transfer position for transferring in the container products and a transfer position for transferring out said products by a displacement device.

10. The apparatus of claim 1, wherein a plurality of inlet nozzles are fitted in parallel with the respective chamber walls of a chamber, said inlet nozzles extending through the chamber wall with their delivery side and as such introducing the tempering medium into the through space of the chamber at a point at which the container products are held in the chamber by the control means in such a way that the tempering medium is in contact with the container product and/or the container content.

11. The apparatus of claim 10, wherein the tempering medium is in contact with the container product and/or the container content close to the bottom of the container product and/or at a right angle.

12. A method for post-treating container products produced by a blow moulding, filling and sealing process; wherein the container products are admitted to a post-treatment zone individually or combined in groups; wherein the length of stay of the respective container products in the post-treatment zone is pre-defined by at least one control means; and wherein the container products pass through the post-treatment zone with the aid of gravity in free fall until the respective control means starts to take effect on the container products.

13. The method of claim 12, wherein a tempering medium is admitted intermittently into the post-treatment zone.

14. The method of claim 12, wherein, in a production step preceding post-treatment, the respective container product is at least partially separated from a waste frame arising during production by means of a separation or punching apparatus.

15. The method of claim 12, wherein the post-treatment zone comprises at least one through shaft for transferring through the container products, which, using the respective control means, enables or prevents the outward transfer operation from the through shaft for the container products.

16. The method of claim 12, wherein the post-treatment zone comprises, along a fall line for the container products, a plurality of through shafts arranged behind one another with the control means.

17. The method of claim 12, wherein a respective through shaft is configured as a chamber, which is open at its free end faces, which are opposite one another, for transferring through the container products, wherein the bottom opening can be sealed by the control means, and wherein the container walls, which are opposite one another, of the container products are transferred through, along the adjacent chamber walls of the respective chamber with an average spacing that can be pre-defined.

18. The method of claim 12, wherein each chamber comprises at least one inlet for a tempering medium, such as a cooling fluid.

19. An apparatus for post-treating container products that are produced by a blow moulding, filling and sealing process, and that can be supplied to a post-treatment zone that applies an influential action to the respective container product; wherein the container products, individually, separated from one another, or combined in individual separate groups comprising a plurality of container products, enter the post-treatment zone, which, furnished with at least one control means acting on the container products, determine the length of stay of said container products in the post-treatment zone; wherein the respective chamber volume of a chamber is no larger than 30 times the volume of the respective container product.

20. A method for post-treating container products produced by a blow moulding, filling and sealing process, wherein the container products are admitted to a post-treatment zone individually or combined in groups, and wherein the length of stay of the respective container products in the post-treatment zone is pre-defined by at least one control means; wherein a tempering medium is admitted intermittently into the post-treatment zone.

* * * * *